US005649512A

United States Patent [19]

Flanery, Jr. et al.

[11] Patent Number: 5,649,512

[45] Date of Patent: Jul. 22, 1997

[54] INDEPENDENT CYLINDER IDLE AIR CONTROL SYSTEM

[75] Inventors: Ansel B. Flanery, Jr., Brighton; William F. Stockhausen, Northville; Robert A. Stein, Saline, all of Mich.

[73] Assignee: Ford Global Technologies, Inc., Dearborn, Mich.

[21] Appl. No.: 678,358

[22] Filed: Jun. 13, 1996

[51] Int. Cl.[6] ..... F02D 41/16

[52] U.S. Cl. ..... 123/339.23; 123/339.27

[58] Field of Search ..... 123/339.19, 339.23, 123/339.25, 339.26, 339.27

[56] References Cited

U.S. PATENT DOCUMENTS

| | | | |
|---|---|---|---|
| 4,438,745 | 3/1984 | Wantanabe | 123/339.27 |
| 4,561,471 | 12/1985 | Diaz | 137/870 |
| 4,771,750 | 9/1988 | Breitkreutz et al. | 123/339.25 |
| 5,063,899 | 11/1991 | Hitomi et al. | 123/339.26 |
| 5,146,888 | 9/1992 | Sawamoto | 123/339.23 X |

FOREIGN PATENT DOCUMENTS

| | | |
|---|---|---|
| 63-113135 | 5/1988 | Japan . |
| 4-287857 | 10/1992 | Japan . |

OTHER PUBLICATIONS

The Effects of Load Control with Port Throttling at Idle–Measurements and Analyses, Newman et al, 890679, Society of Automotive Engineers, Inc., copyright 1989.

*Primary Examiner*—Tony M. Argenbright
*Attorney, Agent, or Firm*—Donald A. Wilkinson

[57] ABSTRACT

An air intake system for an internal combustion engine having a load controlled port throttle system. Specifically the air intake system includes an idle speed control assembly (30), with a metered air line (28) supplying air to a slide metering valve (32). Idle air lines (34) lead from the slide metering valve (32) to the intake ports (16) downstream of the throttle valves (20). The slide metering valve (32) includes a slider plate (50), which can be moved by a solenoid (42) to maintain varying degrees of alignment with outlet passages (48) to the idle air lines (34). In this way, precise amounts of idle air are metered to the intake ports (16) with equal cylinder-to-cylinder air flow and without substantial cross-communication of air between cylinders. A vacuum assembly may also tap into the idle air lines (34) to provide a stable source of vacuum for other engine components.

17 Claims, 2 Drawing Sheets

INDEPENDENT CYLINDER IDLE AIR CONTROL SYSTEM

FIELD OF THE INVENTION

The present invention relates to idle air control devices for internal combustion engines, and more specifically for port throttled internal combustion engines used in vehicles.

BACKGROUND OF THE INVENTION

It is known that, in theory, individual, load-control port throttles (referred to herein as classical) can achieve fast torque response to driver accelerator pedal demand, reduce pumping work at light-medium engine loads and deliver improved combustion stability at light loads with high overlap valve timing compared to plenum throttling.

Furthermore, it is known that, in order to satisfy varying load demands (and therefore, varying engine air flow) at engine idle, current mass-production internal combustion engines require modulation of the idle air flow by some means—usually an idle speed control valve with an actuating solenoid managed by an Engine Control computer. Consequently, an engine with load-control port throttles preferably also has an idle speed control system. This is typically accomplished by using a small idle manifold connected to each of the intake ports downstream of the port throttles. (This will generally be referred to herein as conventional port throttling.) This manifold receives air from an idle speed control valve which regulates the quantity of air for idle operation. However, because the individual intake ports are interconnected with each other through this idle manifold, an average level of intake vacuum is maintained in the idle manifold as the result of each cylinder's being on a different part the 4-stroke cycle. This allows for cross-communication between the cylinders, which is undesirable.

For a light load engine operating condition, there are differences in the cylinder pressure versus volume, between the classical and the conventional port throttling cases. Classical port throttling at light loads achieves full intake port pressure recovery during the intake valve closed period, so when the intake valve opens, the pressure in the port is essentially atmospheric. This atmospheric pressure results in reduced pumping work during the first part of the intake stroke and will also prevent exhaust back flow during the valve overlap period, reducing exhaust residual fraction and improving the combustion stability of the engine at idle. Conventional port throttling that uses an idle manifold, with the interconnection of the intake ports through the idle manifold, reduces the intake port pressure at the time the intake valve opens, which increases the pumping work and provides a significant increase in the exhaust gas back flow, thereby increasing exhaust residual fraction, and thereby reducing combustion stability compared to the classical port throttling case.

A desire exists then, to have a port throttling type of air intake system that operates like a classical throttle, while still incorporating an idle speed control system, without the drawbacks of conventional port throttling.

SUMMARY OF THE INVENTION

In its embodiments, the present invention contemplates an idle air control system for use with a port throttled air intake of an internal combustion engine, having separate intake ports and throttles for each cylinder. The idle air control system includes a metered air line for receiving air into the idle air control system; and a slide metering valve, including a housing having an air inlet operatively engaging the metered air line and a plurality of air outlets in communication with the air inlet, a slider plate movable relative to the plurality of air outlets to selectively partially block communication from the air inlet to the air outlets, and biasing means for biasing the slider plate against the air outlets. The idle air control system also includes actuating means for moving the slider plate relative to the air outlets; and a plurality of idle air lines, each connected at a first end to the plurality of air outlets, for receiving air from the slide metering valve, and each adapted to connect at a second end to a separate one of the intake ports between the throttles and the cylinders.

The present invention further contemplates a method of metering idle air in a port throttled air intake system of an internal combustion engine having separate intake ports and throttles for each cylinder. The method comprises the steps of: providing a slide metering valve including a housing having an air inlet and a plurality of air outlets in communication with The air inlet, a slider plate movable relative to the plurality of air outlets to selectively partially block communication from the air inlet to the air outlets, and biasing means for biasing the slider plate against the air outlets; providing a plurality of idle air lines, each connected at a first end to the air outlets and each adapted to connect at a second end to a separate one of the intake ports between the throttles and cylinders; flowing air into the inlet to the slide metering valve; and actuating the slider plate to selectively restrict the air flow out of the air outlets based upon engine operating conditions.

Accordingly, an object of the present invention is to provide balanced cylinder-to-cylinder air distribution in a port throttle air intake system at engine idle within an internal combustion engine without cross-communication between the cylinders, by the employment of a slide metering valve in an idle speed control assembly.

An advantage of the present invention is that the slide metering valve meters equal idle air to each cylinder and provides intake port pressure recovery to fully utilize the benefits of port throttling, without cross-communication between the cylinders, in order to avoid an increase in the exhaust gas back flow and increased pumping work.

A further advantage of the present invention is that this port throttle air intake system provides for a stable source of vacuum, for easy use with other typical engine accessories, while still keeping the air flow isolated between cylinders. The stable source of vacuum can be drawn from each idle air line in order to avoid a cylinder-to-cylinder maldistribution that can occur if the idle air line of just one cylinder is tapped into.

Another advantage of the present invention is that there is inherent balancing of the cylinder-to-cylinder air distribution from the idle air bypass assembly since the idle control for all cylinders is accomplished with a single precision mechanism and the individual bores for the air flow can be bored at the same time, reducing concerns associated with manufacturing tolerances.

DETAILED DESCRIPTION OF THE PREFERRED EMBODIMENTS

Figure 1:
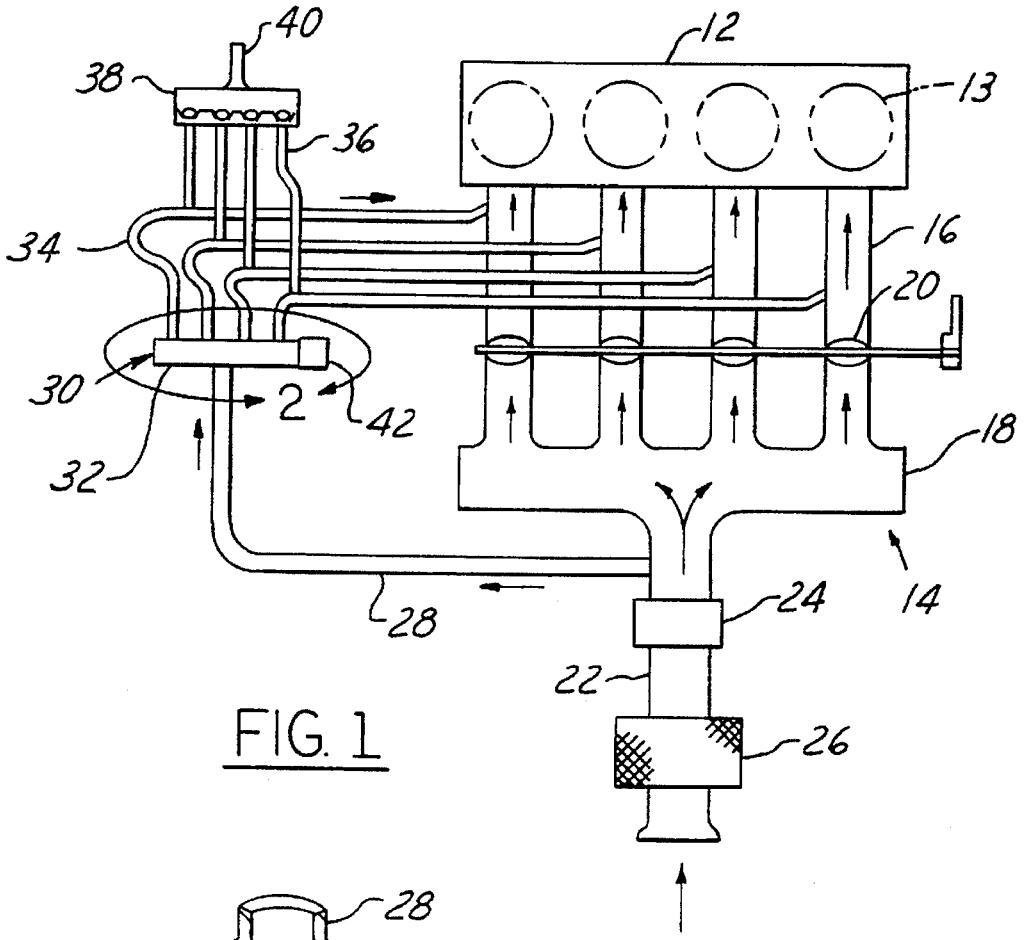
FIG. 1 is a schematic view of an air intake system for an internal combustion engine in accordance with the present invention.

FIGS. 1–5 illustrate a first embodiment of the invention. An internal combustion engine 12 includes an air intake system 14 having a load controlled port throttle type of configuration. An in-line four cylinder engine is illustrated although this invention is equally applicable to engines with other configurations and numbers of cylinders. For example, in a V-type engine, a pair of idle speed control assemblies could be used, one for each bank of cylinders. Four air intake ports 16 extend between the engine 12 and an air intake plenum 18, one to each of the cylinders 13 within the engine 12. Within each of the intake ports 16 is a throttle valve 20, shown herein as butterfly type valves, although other types of throttle valves, such as barrel, may also be employed. A main air intake conduit 22 connects to the intake plenum 18. A mass air flow meter 24 and an air cleaner filter 26 are mounted within the main air intake conduit 22.

Extending from the main intake conduit 22 between the mass air flow meter 24 and the intake plenum 18 is a metered air line 28. The air that flows through this line 28, from the conduit 22, feeds into an idle speed control assembly 30. The idle speed control assembly 30 includes a slide metering valve 32, connected to the metered air line 28, and four idle air lines 34, connected between the slide metering valve 32 and the air intake ports 16. Each of the idle air lines 34 connects to its respective intake port 16 downstream of the corresponding throttle valve 20. Preferably, the idle air lines 34 are of equal length in order to provide equal air flow cylinder-to-cylinder.

A set of four vacuum lines 36 feed off of the idle air lines 34 into a check valve assembly 38. The check valve assembly 38 includes a connector 40 which then can be used as the vacuum source for other conventional engine systems, not shown, which typically operate from a vacuum source. This vacuum source connection from the idle air lines 34 is preferred in order to provide a regulated vacuum source, but is not necessary for the idle control system to function.

The idle speed control assembly 30 includes the slide metering valve 32 and also a solenoid 42 for actuating the valve 32. The solenoid can be a conventional type. The slide metering valve 32 includes a valve housing 44 which has four nipples 46 extending therefrom, each including an outlet passage 48 therein. The idle air lines 34 attach and seal around the outside of the nipples 46.

A slider plate 50 is mounted within the housing 44, with one end 54 protruding through an opening 52 in the housing 44. The opening 52 is shaped to just allow for the slider plate 50 to slide through the opening 52, but tight enough to seal around the plate 50. The end 54 of the slider plate 50 extends into the housing 60 of the solenoid 42 and is attached to armature 56 of the solenoid 42, which acts to move the slider plate 50 during operation.

The slider plate 50 includes four bores 57, which align with the outlet passages 48 of the housing 44. Preferably, the sets of bores and outlet passages are formed simultaneously (such as drilling and reaming after assembly of the two parts), so that they align nearly perfectly. This will allow for increased accuracy and consistency of air flow therethrough. In this way, since the idle air supply to each cylinder is metered through this valve 32, equal cylinder-to-cylinder air distribution is accomplished.

Extending from around the opening 52 is a snap fit flange 58 which mounts to a catch 62 on the solenoid housing 60, in order to seal the slider plate 50 within the idle speed control assembly 30 and prevent contamination from entering and interfering with its operation. This arrangement provides an effective low friction seal of the valve Other attachment configurations can also be used. For instance, if the solenoid 42 is designed to mount so that it is separated from the valve 32 a seal would have to be incorporated where the end 54 of the slider 50 exits the valve housing 44 and this seal would add to the frictional load when actuating the valve.

A cover 64 mounts around the periphery of the valve housing 44, with a seal 66 between the two to seal them together. The cover 64 includes snap latches 68 that grip the housing 44 and hold the cover 64 to the housing 44. A pair of preloaded compression springs 70 are mounted between the slider plate 50 and the cover 64 in order to bias the slider plate 50 against the valve housing 44. Preferably, the housing 44 and slider 50 are made of low friction coefficient material, preferably polymeric, to minimize the power needed by the solenoid 42 during operation. The cover 64 also includes a nipple 74 having an inlet passage 72 therein. Attached about the nipple 74 is the metered air line 28, which receives air into the slide valve 32.

During operation, air is drawn in through the main intake conduit 22, past the air cleaner 26 and mass air flow meter 24. The arrows in the Figs. indicate the direction of air flow. If the engine 12 is operating off-idle, then the port throttle valves 20 are partially opened and most of the air flow to the engine 12 is through the port throttle valves 20. The solenoid 42 will be actuated to slide the slider plate 50 such that the outlet passages 48 are substantially misaligned with the bores 57, restricting the air flow through the metering valve 32. During the later part of the intake stroke in the cylinder, the idle air lines 34, then, will draw a vacuum, creating a vacuum in vacuum lines 36. The slider plate 50, in effect, causes a mini-throttling which results in a pressure drop across each of the openings of the plate 50. This pressure drop isolates the flow in each idle air line 34 from the others.

Figure 4:
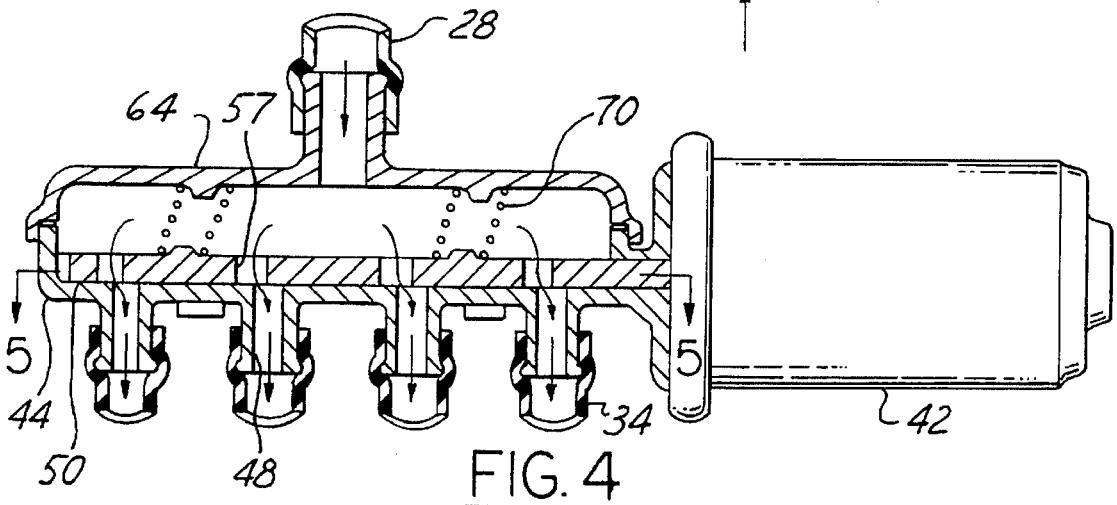
FIG. 4 is a side partial cross-sectional view similar to FIG. 2 with the slider shown in a partially closed position.
Figure 5:
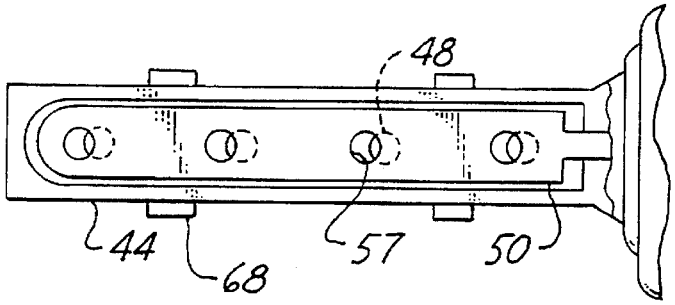
FIG. 5 is a sectional view of the slide metering valve, taken along line 5—5 in FIG. 4.
Figure 2:
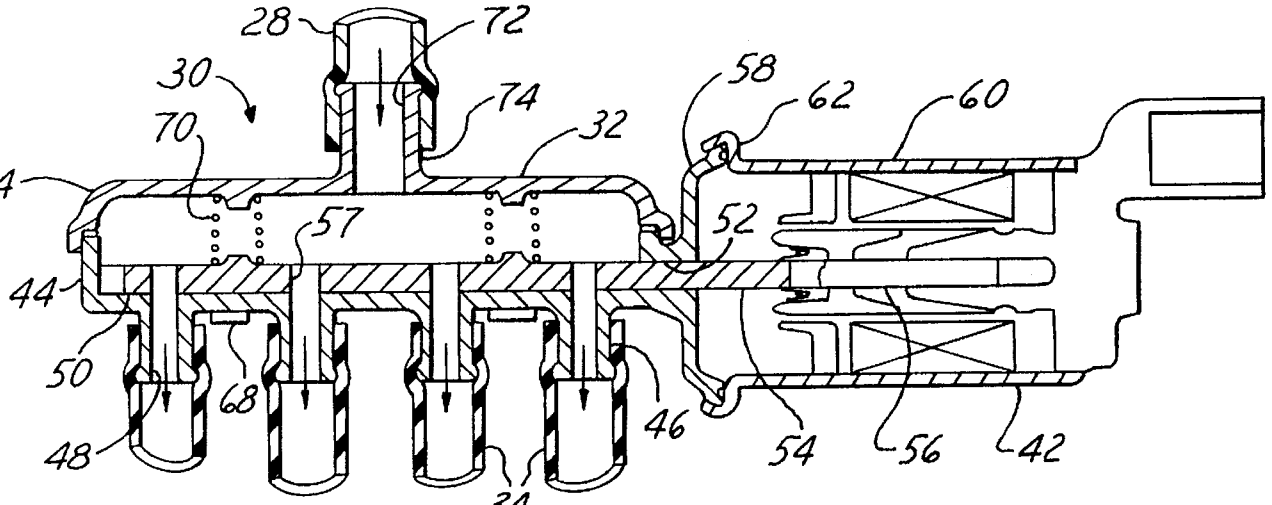
FIG. 2 is a side cross-sectional view, taken from encircled area 2 in FIG. 1 and flipped 180 degrees, of the slide metering valve assembly with the slider in its full open position.

FIG. 2 illustrates the slide metering valve 32 with the slider plate 50 in the fully open position. FIGS. 4 and 5 illustrate the valve 32 with the slider plate 50 in a partially open position, maintaining a restrictive flow path between cylinders that will produce cylinder-to-cylinder isolation with full intake port pressure recovery at light engine loads.

When the engine 12 is operating at idle conditions, the port throttle valves 20 are substantially closed, and most of the air flow to the engine 12 is through the idle speed control assembly 30 The slider plate 50 is positioned by the solenoid 42 to between fully open and partially closed positions to provide precise orifice opening for air flow to the intake ports 16. The amount of opening depends upon the idle air flow needed as determined by an on-board computer (not shown). During idle conditions, the idle air lines 34 will also maintain a vacuum during the later part of the intake stroke due to the fact that most of the air flow is now through the idle speed control assembly 30 and not the port throttles 20.

This concept allows for precision regulation of idle air flow, equal cylinder-to-cylinder air distribution and sufficient restriction between cylinders to allow for full intake port pressure recovery, thus providing for the benefits of classical load control port throttles. The concept of using individual restrictions in air flow for each of the idle air lines 34 communicating with the cylinders in the idle system for a port throttled multi-cylinder engine improves the overall performance of the air intake system for the engine 12. Having one idle valve, which eliminates communication between cylinders and controls the metering of idle air, allows for idle control for each separate port without requiring a separate, independent mechanism to control the idle bypass for each port individually. This allows for increased accuracy in cylinder-to-cylinder distribution while minimizing complexity of the overall idle air system.

Figure 6:
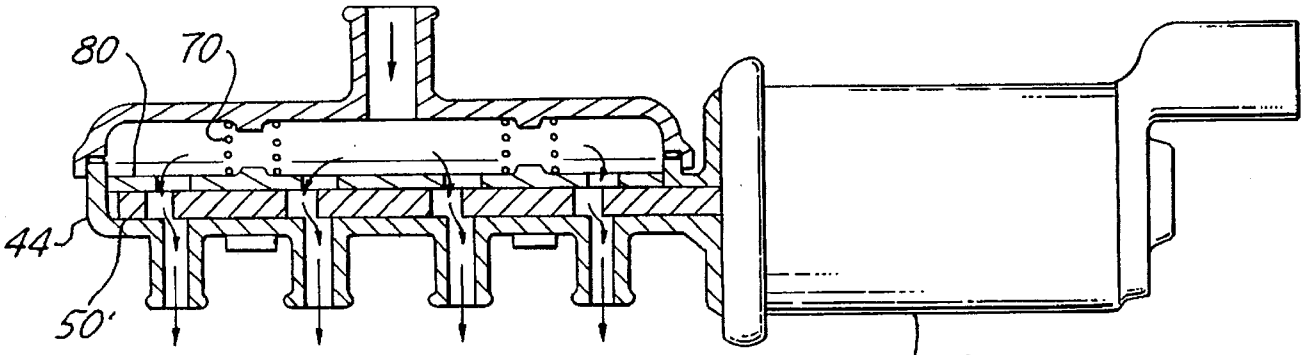
FIG. 6 is a view similar to FIG. 4 illustrating an alternate embodiment of the present invention.
Figure 3:
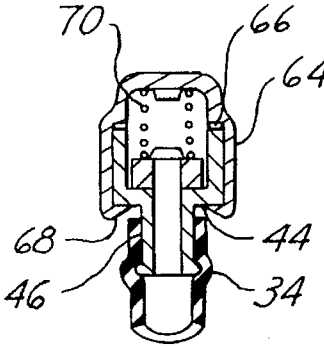
FIG. 3 is an end sectional view of the slide metering valve assembly in accordance with the present invention.
Figure 7:
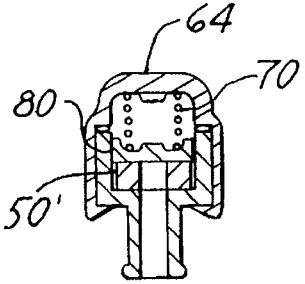
FIG. 7 is an end sectional view of the alternate embodiment shown in FIG. 6.

An alternate embodiment is shown in FIGS. 6 and 7 where a flat, low-friction element 80 is added. It is placed on top of the slider plate 50' and engages the springs 70 in order to offer better function by eliminating the lateral movement of the springs 70 when the slider plate 50' is moved by the solenoid 42, and also allowing for more restriction of air flow for a given amount of movement of the slider plate 50'.

While certain embodiments of the present invention have been described in detail, those familiar with the an to which this invention relates will recognize various alternative designs and embodiments for practicing the invention as defined by the following claims.

We claim:

1. An idle air control system for use with a port throttled air intake of an internal combustion engine, having separate intake ports and throttles for each cylinder, the idle air control system comprising:

a metered air line for receiving air into the idle air control system;

a slide metering valve, including a housing having an air inlet operatively engaging the metered air line and a plurality of air outlets in communication with the air inlet, a slider plate movable relative to the plurality of air outlets to selectively partially block communication from the air inlet to the air outlets, and biasing means for biasing the slider plate against the air outlets;

actuating means for moving the slider plate relative to the air outlets; and a plurality of idle air lines, each connected at a first end to the plurality of air outlets, for receiving air from the slide metering valve, and each adapted to connect at a second end to a separate one of the intake ports between the throttles and cylinders.

2. The idle air control system of claim 1 wherein the actuating means is a solenoid connected to the slider plate.

3. The idle air control system of claim 1 wherein the plurality of idle air lines are all substantially the same length.

4. The idle air control system of claim 1 further comprising means for drawing a vacuum from the idle air lines.

5. The idle air control system of claim 1 wherein the biasing means includes a substantially stationary plate slidably mounted to the slider plate and coil springs biased against the stationary plate to thereby bias the slider plate against the outlets in the housing.

6. The idle air control system of claim 1 wherein the biasing means are compression springs pressing against the slider plate.

7. The idle air control system of claim 1 wherein the slider plate is made of a low friction material.

8. The idle air control system of claim 1 wherein the slider plate extends through an opening in the housing, the opening being enclosed by the actuating means.

9. A port throttled air intake system for an internal combustion engine comprising:

an air intake conduit;

a plurality of intake ports for receiving air from the air intake conduit and delivering it to the engine;

a plurality of throttle valves, one in each of the intake ports;

a metered air line for receiving air from the air intake conduit upstream of the throttle valves;

a slide metering valve including a housing having an air inlet operatively engaging the metered air line and a plurality of air outlets in communication with the air inlet, a slider plate movable relative to the plurality of air outlets to selectively partially block communication from the air inlet to the air outlets, and biasing means for biasing the slider plate against the air outlets;

actuating means for moving the slider plate relative to the air outlets; and a plurality of idle air lines, each connected at a first end to the slide metering valve and each connected at a second end to a separate one of the intake ports downstream of the throttle valves.

10. The air intake system of claim 9 further including a mass air flow meter in the air intake conduit upstream of the metered air line.

11. The air intake system of claim 9 wherein the plurality of idle air lines are all substantially the same length.

12. The air intake system of claim 11 further comprising means for drawing a vacuum from the idle air lines.

13. The air intake system of claim 12 wherein the means for drawing a vacuum comprises a plurality of vacuum lines connected to the idle air lines and a check valve assembly connected to the plurality of vacuum lines.

14. The air intake system of claim 9 wherein the housing is made of two pieces, a main housing piece which includes the plurality of outlets and a cover piece which includes the air inlet and also includes snap latches for mounting to the main housing piece.

15. The air intake system of claim 14 wherein the slider plate extends through an opening in the main housing piece, the opening being enclosed by the actuating means.

16. A method of metering idle air in a port throttled air intake system of an internal combustion engine having separate intake ports and throttles for each cylinder, the method comprising the steps of:

providing a slide metering valve including a housing having an air inlet and a plurality of air outlets in communication with the air inlet, a slider plate movable relative to the plurality of air outlets to selectively partially block communication from the air inlet to the air outlets, and biasing means for biasing the slider plate against the air outlets;

providing a plurality of idle air lines, each connected at a first end to the air outlets and each adapted to connect at a second end to a separate one of the intake ports between the throttles and cylinders;

flowing air into the inlet to the slide metering valve; and actuating the slider plate to selectively restrict the air flow out of the air outlets based upon engine operating conditions.

17. The method of claim 16 further including the step of drawing a vacuum off of the idle air lines.

* * * * *